US005618149A

United States Patent [19]

Beaumont et al.

[11] Patent Number: 5,618,149

[45] Date of Patent: Apr. 8, 1997

[54] VEHICLE ELEVATOR

[76] Inventors: Steven A. Beaumont, 20 River Road, Lane Cove West, NSW, 2066; Daniel Brosnan, 21 Jamieson Avenue, Fairlight, NSW, 2094; Rodney Josey, 855 Punchbowl Road, Punchbowl, NSW, 2196, all of Australia

[21] Appl. No.: 448,601

[22] PCT Filed: Nov. 24, 1993

[86] PCT No.: PCT/AU93/00597

§ 371 Date: Jun. 7, 1995

§ 102(e) Date: Jun. 7, 1995

[87] PCT Pub. No.: WO94/12410

PCT Pub. Date: Jun. 9, 1994

[30] Foreign Application Priority Data

Nov. 25, 1992 [AU] Australia ..... PL6031

[51] Int. Cl.[6] ..... B65G 1/04

[52] U.S. Cl. ..... 414/253; 414/255; 414/259; 414/264; 414/280

[58] Field of Search ..... 414/227, 233, 414/252, 253, 254, 255, 256, 260, 259, 261, 264, 280, 277, 281

[56] References Cited

U.S. PATENT DOCUMENTS

| | | | |
|---|---|---|---|
| 2,840,187 | 6/1958 | Bianca . | |
| 2,845,189 | 7/1958 | Sanders | 414/256 |
| 2,876,913 | 3/1959 | Roth et al. | 414/253 |
| 3,800,963 | 4/1974 | Holland . | |
| 5,018,926 | 5/1991 | Sternad | 414/255 X |
| 5,238,348 | 8/1993 | Reimer | 414/255 X |

FOREIGN PATENT DOCUMENTS

| | | | |
|---|---|---|---|
| 266520 | 9/1987 | European Pat. Off. . | |
| 322539 | 5/1989 | European Pat. Off. . | |
| 0481205 | 4/1992 | European Pat. Off. . | |
| 1134157 | 11/1956 | France | 414/256 |
| 1304758 | 8/1962 | France | 414/259 |
| 2058390 | 8/1970 | France . | |
| 2459190 | 6/1976 | France . | |
| 860928 | 7/1949 | Germany . | |
| 0502453 | 9/1992 | Germany . | |
| 4207446 | 9/1992 | Germany . | |
| 281000 | 5/1952 | Switzerland . | |
| 1380010 | 8/1972 | United Kingdom . | |
| 92/03629 | 3/1992 | WIPO . | |

*Primary Examiner*—Frank E. Werner
*Attorney, Agent, or Firm*—Lowe, Price, LeBlanc & Becker

[57] ABSTRACT

A storage system (10), preferably for vehicles comprising a plurality of storage bays (11) each having an opening, at least one moving device (15) movable to be adjacent the opening of any one of the storage bays (11) and transfer device (90, 20) for transferring objects (21) carried by the moving devices (15) into the storage bay (11). Preferably the storage bays (11) are arranged in two arrays and the moving devices (15) is capable of transferring an object to a storage bay (11) in either array.

16 Claims, 8 Drawing Sheets

VEHICLE ELEVATOR

TECHNICAL FIELD

This invention relates to storage systems having a plurality of storage bays for storing articles. More particularly it relates to a system useful in storing vehicles.

BACKGROUND ART

In urban areas it is common to provide multilevel car parking buildings. The buildings have multiple floors connected by ramps. One drives a vehicle from floor to floor until a free parking bay is found. Such car parks have a low usage of floor space due to the need for roadways and the requirement that each parking bay be sufficiently large to allow a vehicle to be driven into the bay and for the driver and any passengers to exit the vehicle.

It has been proposed to replace access ramps with a vertical lift to each floor. However it is still necessary to provide roadways on each floor and large size parking bays. It has also been proposed to use lifts which not only have a platform which can be moved vertically to access parking bays on different levels but which also have a transport device which moves the vertical lift horizontally to access laterally adjoining parking bays.

DISCLOSURE OF THE INVENTION

The present invention provides in one of its aspects a Lifting transfer device for use in a storage system having a plurality of first storage bays, each storage bay having an access opening through which an object may be inserted into or removed from the storage bay, said access openings arranged in a first common surface, the device comprising:

transport means restrained to move in a horizontal plane and in a direction parallel to the common surface;

lift means mounted on the transport means and restrained to move vertically relative to the transport means and in a direction parallel to the common surface; and transfer means mounted on the lift means characterised by having:

a first wheeled trolley for receiving and supporting an object thereon, said first wheeled trolley supported on the lift means and movable thereon from a position distant from the storage bay to a position next to or partially in the storage bay, and drive means having first and second modes of operation, said first mode of operation causing said first wheeled trolley to move relative to the lift means and said second mode of operation for driving the object from the wheeled trolley into the storage bay or from the storage bay onto the wheeled trolley whilst the first wheeled trolley is prevented from moving relative to the lift means.

Preferably the object comprises a second wheeled trolley adapted to be supported on the first wheeled trolley and adapted to support a wheeled vehicle.

In a second aspect of the present invention there is provided a storage system comprising a first plurality of storage bays, each storage bay having an access opening through which an object may be inserted into or removed from the storage bay, said access openings arranged in a first common surface, and a lifting transfer device of the above-mentioned kind.

Preferably the storage bays are arranged with their openings arranged on at least one vertical surface.

More preferably the vertical surface is planar.

Preferably the transport means is movable run along a horizontally extending track.

Preferably the lift means is cantilevered from the main frame of the transport means and extends transversely of the vertical face.

More preferably the main frame comprises two spaced apart parallel uprights and the lift means comprises a sub-frame having two spaced apart parallel L-shaped support members, each depending from a respective upright.

More preferably the uprights comprise I beams and the support members include guide wheels which run in the channels of the I beams.

Preferably the storage bays are arranged in two stacks with the openings of the stacks opposing and at least one lifting transfer device located intermediate the opposing openings.

Preferably the or each lifting transfer device is capable of moving an object to any bay in both stacks. Even more preferably there are provided two lifting transfer devices located intermediate the opposing openings, each of which may access any bay in both stacks.

BRIEF DESCRIPTION OF THE DRAWINGS

The invention will be better understood from the following description of a preferred but non-limiting embodiment which is provided with reference to the drawings in which.

BEST MODE FOR CARRYING OUT THE INVENTION

Figure 1:
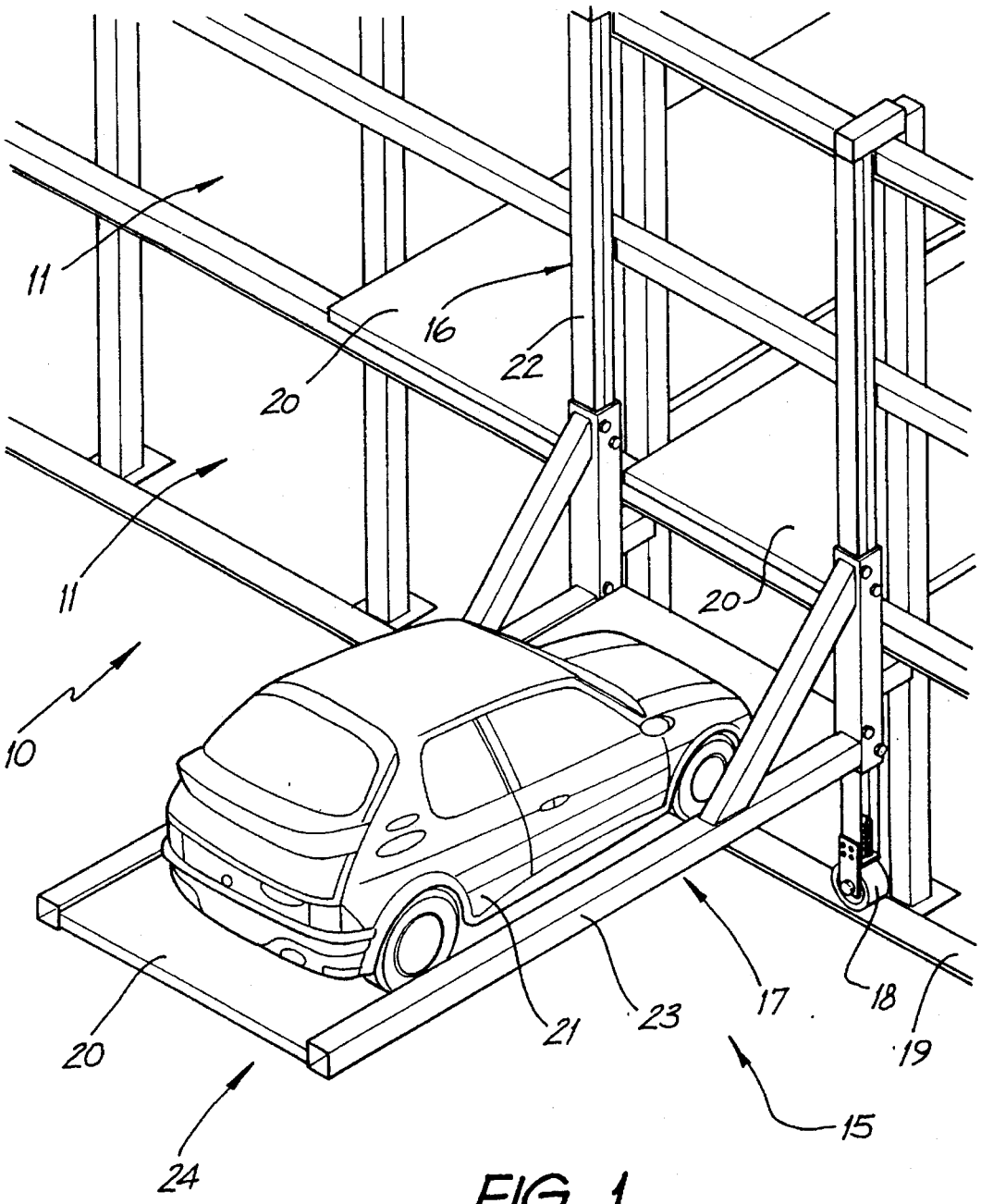
FIG. 1 is a schematic perspective view of an embodiment of the invention.
Figure 2A:
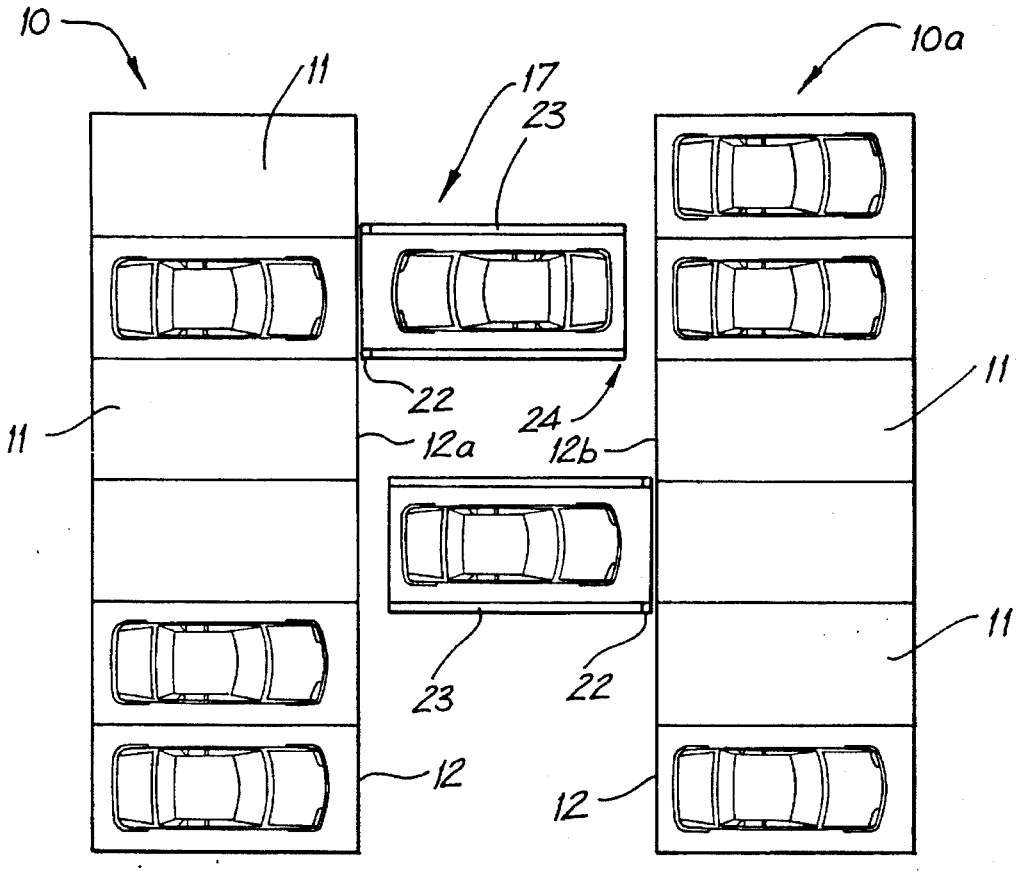
FIG. 2*a* is a schematic plan view of the embodiment of FIG. 1.
Figure 2B:
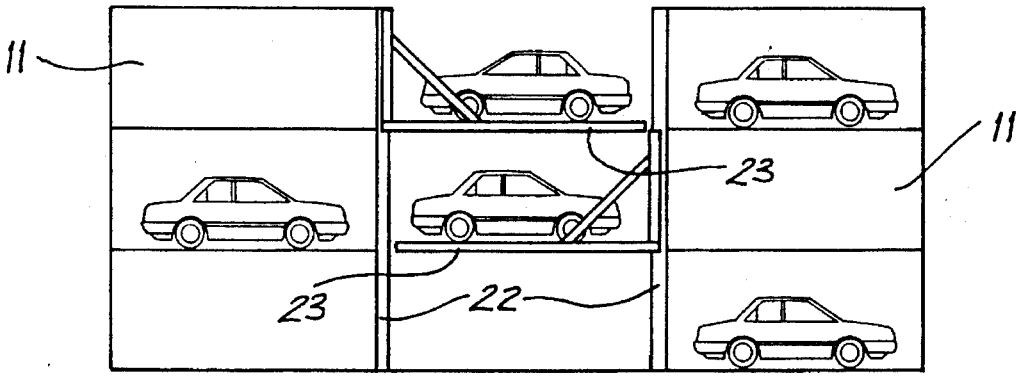
FIG. 2*b* is a schematic side view of the embodiment of FIG. 1.

Referring to FIGS. 1, 2*a* and 2*b* there is provided a storage structure 10 having a plurality of storage bays 11. The bays 11 are arranged in rows and columns and each have an opening on a vertical front face 12.

The bays 11 may be constructed of concrete or steel girders or any other suitable material with or without floors, walls or ceilings. Mounted adjacent the front face 12 is a lifting mechanism 15. The lifting mechanism 15 comprises a main frame 16 extending the height of the columns of bays 11 and a sub-frame 17 mounted on the main frame 16. The main frame 16 is supported by wheels 18 and is movable horizontally across the front face 12 upon a track 19 while the sub-frame 17 is movable vertically relative to the main frame. The movement of the two frames may be achieved by any of a number of conventional means, such as a rack and pinion system or hydraulic rams. By appropriate movement of the main frame 16 and sub-frame 17 it is possible to position the sub-frame 17 adjacent any selected storage bay 11.

The sub-frame 17 supports a wheeled pallet 20 which in turn supports an article 21 to be stored. When the sub-frame 17 is positioned adjacent the relevant bay 11, a transfer mechanism (not shown) transfers the pallet 20 and its article 21 into the bay 11, or vice versa. Once an article 21 has been placed in a bay, the lifting mechanism 15 may retrieve or place another article from or into another storage bay.

The main frame 16 of the lifting mechanism comprises a pair of spaced apart vertical column members 22 while the sub-frame 17 comprises two spaced apart horizontal arms 23 extending away from the front face 12. The column members 22 are horizontally braced so as to remain parallel. Such bracing is not shown in the drawings.

As shown in FIGS. 2*a* and 2*b* a second set of storage bays 10*b* may be placed adjacent the free end 24 of the sub-frame 17 and, with a suitable transfer mechanism capable of transferring a pallet 20 from both stacks of bays, a single lift 15 may service both stacks. It is further possible to provide a second lifting mechanism which runs along the front face of the second stack. The spacing between the two opposing front faces 12*a*, 12*b* must be increased such that the free end of one sub-frame can pass the main frame of the other lift. Such an arrangement allows for continued operation should one of the lifts require maintenance or repairs, since the other lift can access all bays on both stacks without hindrance from the other lift. It will be appreciated that in a two lift arrangement a gap must exist between the free end of each sub-frame and the front face adjacent to that free end. Thus by necessity the transfer mechanism must be capable of transferring a pallet off the free end of the sub-frame over the gap and into the storage bay without failure or jamming. Further if, as will be normal, there exists a gap between the front face and the inside end of the sub-frame, then the gap at the free end will be greater than this gap at the inner end.

By horizontal movement of the main frame 16 any one of the columns of storage bays may be accessed. By vertical movement of the sub-frame 17 any one of the rows of storage bays may be accessed. Thus by appropriate movement of the main frame 16 and sub-frame 17, the sub-frame 17 may be positioned adjacent any storage bay.

Figure 3:
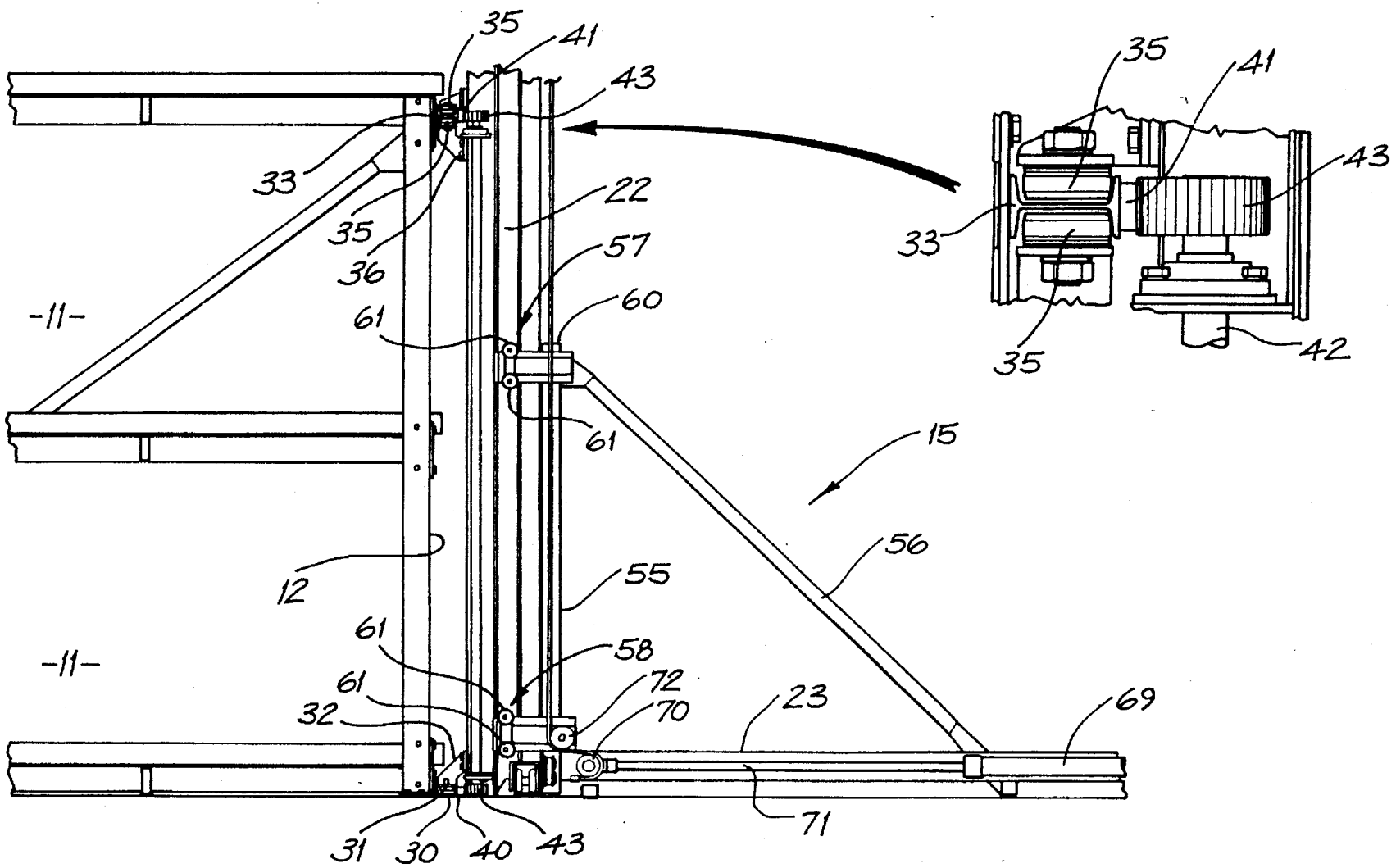
FIG. 3 is a side view of an embodiment of the invention showing hidden detail and with the transfer plate and pallet not shown.
Figure 4:
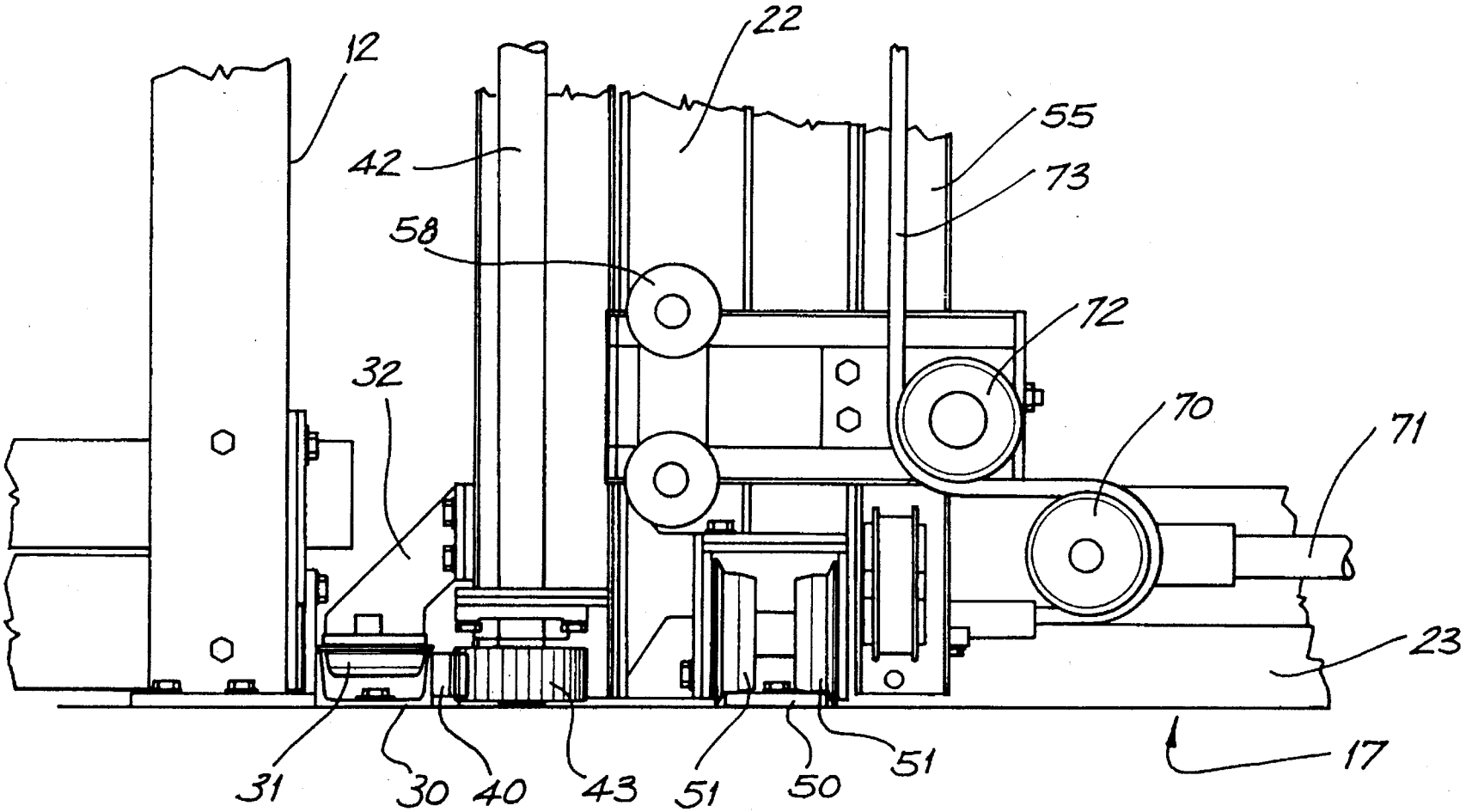
FIG. 4 is an expanded view of part of FIG. 3.

Referring to FIGS. 3 and 4, the stacks of bays along which the lifting mechanism 15 runs is provided with a lower guideway on the ground. The lower guide track is a U-shaped channel in which runs lower guide wheels 31 attached to the main frame via a mounting 32. Each vertical column member 22 is preferably provided with a lower guide wheel 32. An upper guide way 33 is provided adjacent the second level and comprises an I beam having the channels 34 of the I facing upwards and downwards. As an alternative, the I beam may be replaced with two C-sections arranged with their bases abutting and their channels facing upwards and downwards. In fact, how the channels are provided is unimportant. Two sets of two upper guide wheels 35 depending from the two column members 22 of the main frame 16 via mountings 36 run in the two channels 34 of the I beam 33. Preferably the upper and lower guide wheels 31, 35 are flanged to limit movement into the appropriate channel 30, 34.

Mounted on the external vertical face of the lower guideway 30 is a horizontally extending toothed track 40. A similar toothed track 41 is mounted on the external face of the upper guideway 33. The main frame 16 rotatably supports a vertical shaft 42 having toothed cogs 43 at each end which engage the upper and lower toothed tracks 40, 41. A motor 44 is provided to rotate shaft 42 and hence cogs 43. By rotation of the shaft 42, the cogs 43 drive the lifting mechanism 15 horizontally along the side of the stacks. The shaft 42 and cogs 43 act to maintain the column members 22 vertical, since both the upper and lower ends are constrained by the rack and pinion arrangement to move together. Although the mainframe 16 may be provided with only one shaft 42 (although two may be used), due to the bracing between the two upright members 22, both members 22 are maintained in a vertical position.

There is provided a horizontal track 50 extending parallel to the front surface 12 upon which the main frame 16 runs. Preferably this track is mounted on the ground but it could be mounted on the stacks above ground. Each column 22 of the main frame 16 is provided with at least one pair of opposed flanged wheels 51. The wheels 51 run on the upper surface of the track while their flanges are adjacent the side edges of the track, thus restraining the wheels to run along the track.

The two column members 22 of the main frame are preferably each comprised of an I beam. The sub-frame 17 is comprised of the two horizontally extending arms 23, each opposite one of the I beams 22, a vertical leg 55 and a bracing member 56. The sub-frame 17 has two sets of guide wheels 57, 58 mounted upon each of the vertical legs 55. It is preferable that the two sets of each leg be spaced as far apart as practical. Thus the upper set of guide wheels 57 is adjacent the free end 60 of the leg 55 while the lower set 58 is adjacent the junction of the leg 55 and arm 23. Preferably each set comprises two guide wheels 61. The guide wheels are mounted in the outwardly facing channels of the I beams 22 and run along the flanges of the beams.

In the embodiment shown there is provided a hydraulic ram 69 in or beside one of the arms 22 of the sub-frame 17 having a first pulley 70 mounted on the free end of the piston rod 71. An idler pulley 72 is mounted near the junction of the leg 55 and arm 73 and a cable 73, which is attached at or near the top of the main frame 16, passes under the idler pulley 72, around the first pulley 70 and is then secured to the sub-frame 17. Contraction of the hydraulic ram 69 thus causes the sub-frame 17 to rise. It will be appreciated that two rams, each in or adjacent each arm, may be used.

Whilst a rack and pinion system is used to move the main frame 16 and a hydraulic ram/cable system is used for the sub-frame 17 it will be appreciated that other drive systems may be used for each use.

Figure 5:
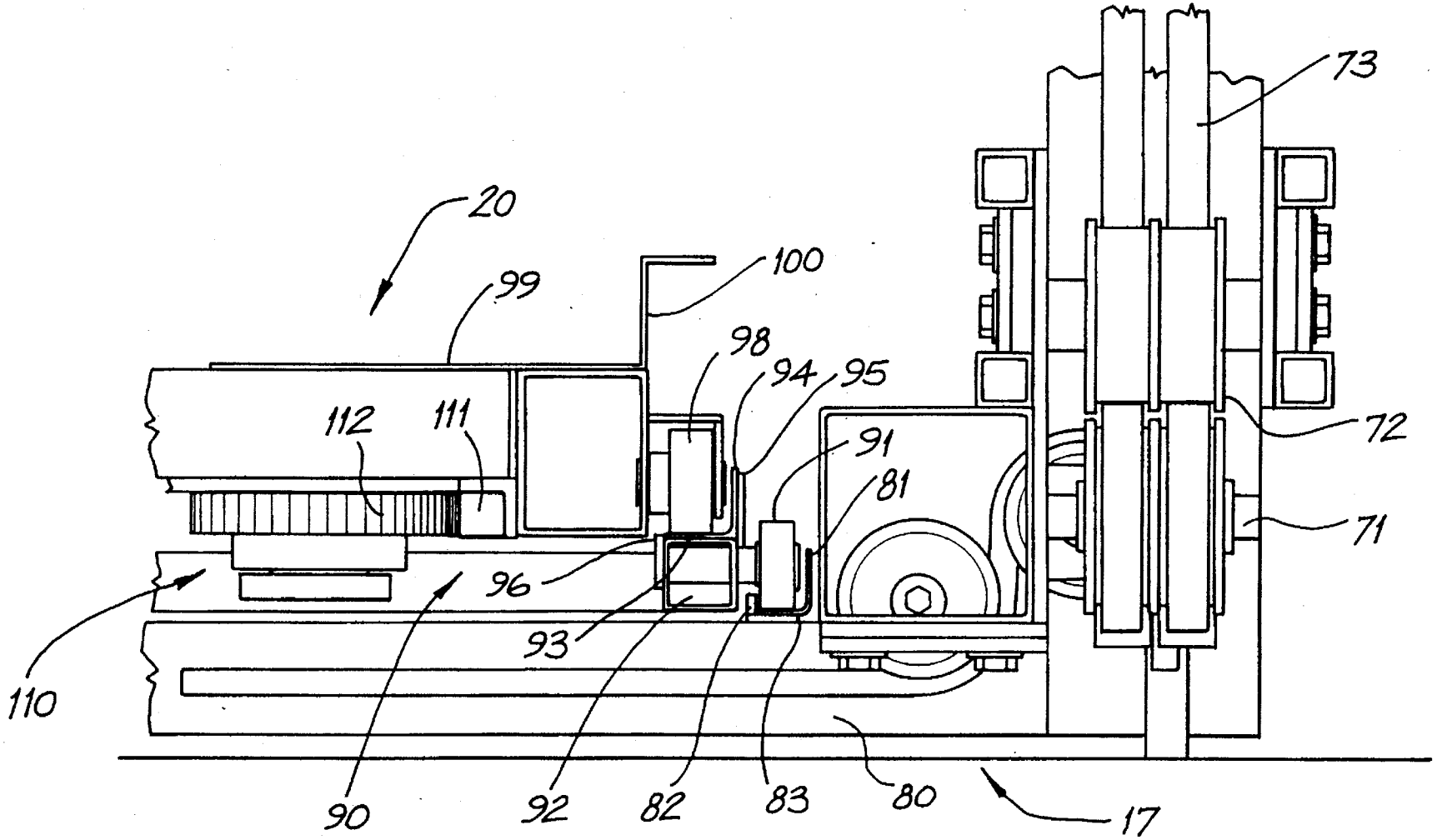
FIG. 5 is a partial end cross-sectional view through the sub-frame of the embodiment of FIG. 3.

Referring to FIG. 5, the construction of the sub-frame 17 is shown in more detail.

The two horizontally extending arms 23 are joined together on their bottom surfaces by transverse beams 80. An angle 81 extending parallel to each arm 23 is provided on the inner face of the arm resting upon the transverse beams 80. Preferably this angle 81 is welded or brazed to the arm and beams. The angle has a vertical leg 82 on its inner edge and carries a first running track 83.

A wheeled transfer plate 90 is provided which has wheels 91, 97 mounted on its side edges to run along the first running tracks. Preferably the transfer plate 90 has horizontally extending square hollow section beams 92, parallel to the arms 23, from which the wheels 91, 97 extend. The wheels 91 are mounted about horizontal axes and engage the horizontal surface of the running track 83. The wheels 97 are mounted on vertical axes and engage the vertical surface of the running tracks 83. Thus the transfer plate is constrained to run parallel with the running tracks 83 and is prevented from sideways movement. Mounted upon the top surface 93 of each of the beams 92 is a second running track 94. A wheeled pallet 20 is provided having wheels 98, 101 on its side edges. As with the transfer plate, the wheels 98 rotate about horizontal axes and engage the horizontal surfaces of the second running track 94 and the wheels 101 rotate about vertical axes to engage the vertical surfaces of the second running tracks 94. The two running tracks 94 thus restrain the wheels 98 from sideways movement off the transfer plate 90. It will be appreciated that the horizontally and vertically mounted wheels of the transfer plate and pallet may be replaced by linear bearings.

The upper surface 99 of the pallet 20 is provided with upstanding side edges 100 such that an article placed on the upper surface 99 is constrained between the side edges 100. Where the article is a wheeled vehicle the upstanding side edges 100 prevent the vehicle being driven off the side of the pallet 20 when placing the vehicle on the pallet 20.

Although not shown, the transfer plate 90 may be provided with a centrally located guide channel into which a guide member extending from the lower side of the pallet engages. The guide channel serves to locate the pallet correctly relative to the transfer plate and in particular ensures that the pallet wheels run on the tracks. Preferably at the ends of the guide track the sides expand outwards in a bell shape so the pallet may engage the guide member even when slightly miss-aligned. The sides of the guide track may be undercut so as to prevent the guide member disengaging by vertical movement.

As will be apparent from FIG. 4 the inner end of the sub-frame 17 adjacent the front faces 12 of the bays 11 ends some distance from the front face 12. Similarly with a two-stack system having two lifting mechanisms, the free end of the sub-frame is distant from the other front face. Thus it is not possible to transfer the pallet directly from the lift mechanism to the bay unless the relevant gap is closed. This is the purpose of the transfer plate 90.

The lift mechanism 16 is positioned so that the second running tracks 94 on the transfer plate 90 are aligned with the storage bay's floor or running surface. The transfer plate 90 is rolled along the first running tracks 83 until it abuts against the end of the bay, thus forming a continuous horizontal surface upon which the pallet's wheels 98 may roll. The pallet 20 is then driven by a drive mechanism from the transfer plate 90 onto the storage bay floor or running surface. As shown in FIG. 5 the drive mechanism 110 may comprise a linear toothed track 111 on the underside of the pallet and a rotatable cog 112 driven by a suitable motor (not shown) on the transfer plate 90. However other drive mechanisms, such as a chain having an arm which engages a complementary arm or recess on the pallet 20 may be used. However the drive mechanism must be capable of driving the pallet off both ends of the support frame and also retrieving a pallet in a storage bay and driving it onto the transfer plate. In this regard the drive mechanism may extend into the storage bay to engage a pallet stored therein.

Figure 7:
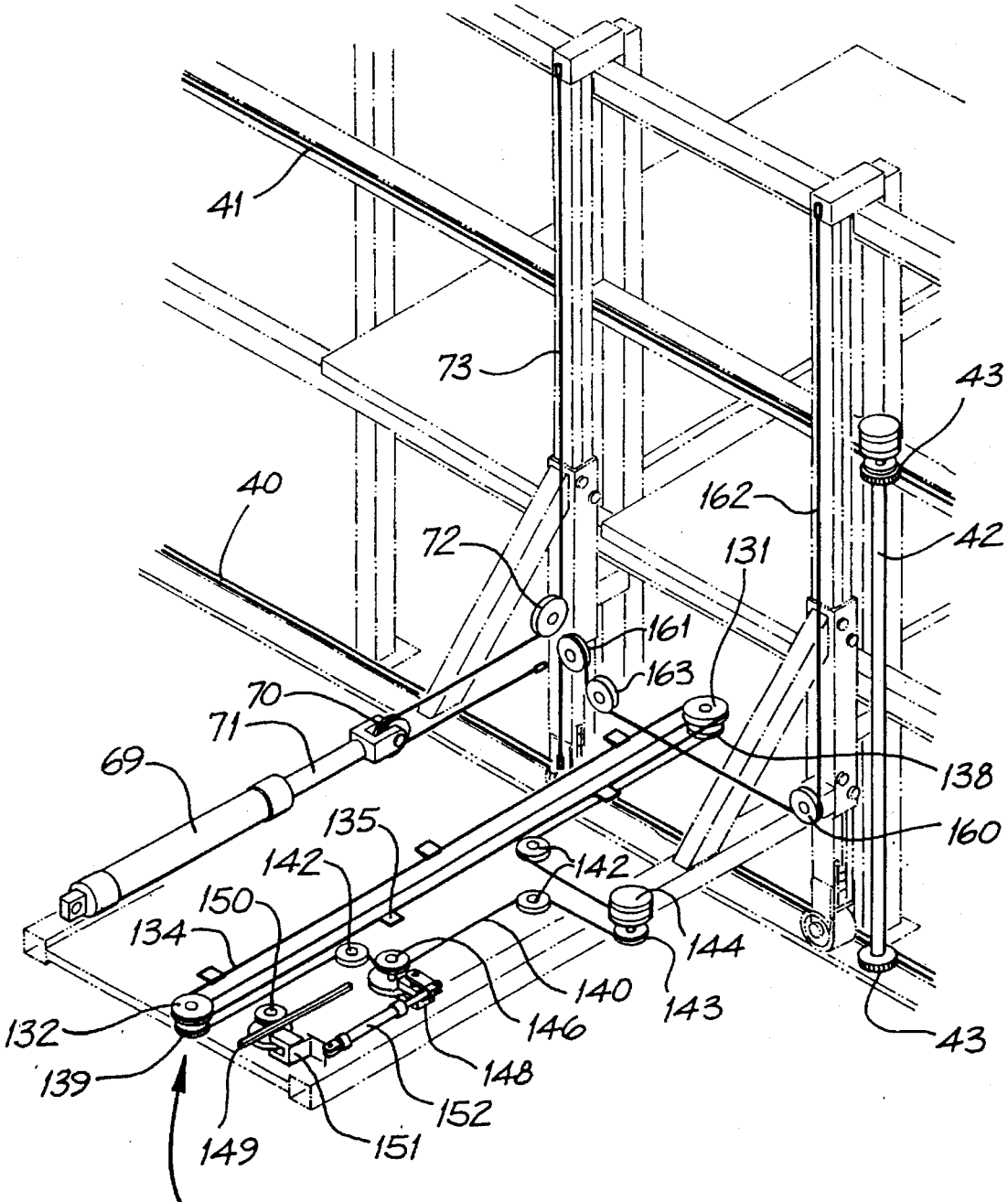
FIGS. 7 and 7*a* show details of the drive mechanisms of the embodiments.
Figure 7A:
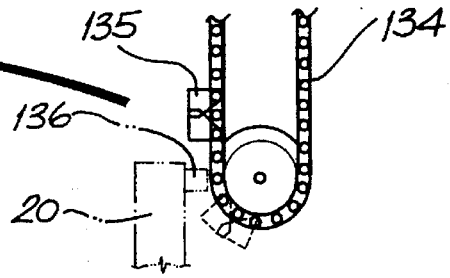

Referring to FIGS. 7 and 7*a*, there is shown a mechanism for driving the mainframe, sub-frame and in particular there is shown the transfer mechanism 130.

The transfer mechanism 130 includes first and second pulley wheels 131, 132 rotatably mounted on and above the top surface of the transfer plate 90. The first pulley 131 is mounted near the inner end of the transfer plate 90 while the second pulley 132 is mounted near the free end 24.

A first flexible member 134, preferably a chain, is wrapped around the pulleys 131, 132 such that rotation of the pulleys causes circulation of the flexible member 134. It will be appreciated that when the flexible member is a chain the "pulleys" will be toothed cogs. It is to be understood that in the following description of the transfer mechanism the word "pulley" is to also mean "cog". Mounted on the flexible member 134 at regular intervals are pairs of drive arms 135. Where the flexible member is a chain, each arm 135 of each pair is mounted on a separate link of the chain so the pairs of arms abut. However the arms 135 are not fixed together, such that the chain may rotate about each pulley. Alternatively, only one arm may be provided rather than pairs. A single arm can be mounted on both pins of a single link.

The two pulleys 131, 132 may be mounted in the centre of the transfer plate 90, as shown, or may be mounted at one side of the transfer plate. The pallet 20 has an inwardly extending arm 136 at each end which extends to be adjacent the flexible member 134 such that the drive arms 135 may engage them.

Rotation of the pulley wheels 131, 132 will cause the drive arms 135 to engage the pallet's arm 136 and drive the pallet 20 towards the right, as viewed in FIG. 7. Similarly, a counter clockwise rotation will drive the pallet 20 towards the left. It will be appreciated that the pallet 20 may be driven in either direction so that it is substantially off the transfer plate 90, as shown in the detail in FIG. 7*a*.

As mentioned previously it is necessary for the transfer plate 90 to move relative to the sub-frame 17. Accordingly, third and fourth pulley wheels 138, 139 are provided which are rotatably linked to the first and second pulley wheels 131, 132 respectively. In the embodiment shown, the third and fourth pulley wheels 138, 139 are mounted coaxial with the first and second pulley wheels 131, 132 on common axles. However, if desired a gear arrangement may be utilised.

The third and fourth pulley wheels 138, 139 may be mounted above the top surface of the transfer plate 90 or the axle may extend through the transfer plate 90 and the pulleys 138, 139 may be mounted below the lower surface. However, their positioning is relatively unimportant.

A second flexible member 140, again preferably a chain, is wrapped around the third and fourth pulley wheels 138, 139 around idler pulleys 142 and hence around a drive pulley 143 driven by a suitable motor 144. The flexible member 140 also engages a brake pulley 146 which is connected to a first brake mechanism 148, preferably a disc brake.

The transfer plate 90 is also preferably provided with a longitudinally extending rack 149 which engages a pinion 150. The pinion is connected to a second brake mechanism 151, again preferably a disk brake. Preferably, the disk brakes are mechanically operated by a double hydraulic ram 152 such that when one brake is engaged the other is disengaged and vice versa. The brake mechanisms 148, 151 of both disk brakes are secured to the sub-frame 17.

The second brake 151 acts to prevent movement of the transfer plate 90 when engaged. When the second brake 151 is engaged and the first brake 148 disengaged, rotation of the motor 144 merely causes the first and second flexible members 134, 140 to circulate and to drive the pallet 20 off in the appropriate direction while the transfer plate 90 remains stationary.

When the first brake 140 is engaged and the second brake 151 released, the transfer plate 90 is free to move relative to the sub-frame 17 and the second flexible member 140 is fixed relative to the brake pulley 146.

If the motor 144 is now driven to cause an anticlockwise rotation of the drive pulley 143, the length of flexible member 140 between the brake pulley 146 and the drive pulley 143 is reduced. The drive pulley 143 is mounted on the transfer plate 90 and the brake pulley 146 is mounted on the sub-frame 17 and so the transfer plate 90 is urged towards the left. Simultaneously to this movement, the first and second pulleys 131, 132 are caused to rotate in an anticlockwise direction, since they are fixed relative to the drive pulley 143. Accordingly, the pallet 20 is driven towards the left relative to the transfer plate 90. Once the transfer plate 90 has been driven sufficiently to the left, to span the gap between the storage bays 11 and the free end 24 of the sub-frame 17, the hydraulic ram 152 may be cycled to engage the second brake 151 and to disengage the first brake 148, thereby locking the transfer plate 90 relative to the sub-frame 17. The pallet 20 may then be driven off the transfer plate 90 by continued rotation of the motor 144 to be supported only by the storage bay's floor.

Once the pallet 20 is in the storage bay 11 the ram 152 is cycled to again engage the first brake 148 and the motor 144 is then driven in a clockwise direction, thereby urging the transfer plate 90 towards the right. It will be appreciated that if there is a sufficient spacing between the drive arms 135 on the first flexible member 134, the transfer plate 90 will have retracted a sufficient distance such that the driven arm 136 of the pallet 20 is not engaged by a drive arm 135 as it rounds the second pulley 132.

To retrieve the pallet 20 the cycle is reversed to firstly drive the transfer plate 90 to adjacent the appropriate bay 11. Then the pallet 20 is retrieved onto the transfer plate 90 and finally both pallet 20 and transfer plate 90 moved to lie fully on the sub-frame 17. It will be appreciated that by driving the motor 144 in the opposite direction and by appropriate sequencing that a pallet 20 may be deposited and retrieved into and from a storage bay on the right hand side (inner end) of the sub-frame 17. It will also be appreciated that where the gaps at the end of the sub-frame 17 are different, the movement of the transfer plate 90 must also be different. However, it will be appreciated that, when extended, the transfer plate 90 abuts against the outer edge of the storage bay 11, so merely driving the pallet 20 off the transfer plate 90 will position it correctly relative to the storage bay 11—no precise control in driving the pallet off the transfer plate is necessary.

FIG. 7 also shows an arrangement to ensure that both sides of the sub-frame 17 rise up the column members 22 equally when only a single lift ram 69 is used. The equalising arrangement comprises a first pulley 160 mounted on one side of the sub-frame 17 and a second pulley 131 mounted on the other side. A flexible member 162 such as a wire, cable or chain is provided which is attached at one end to the top of one of the upright column members and at the other end to the bottom of the other upright column member 22. The flexible member 162 is passed underneath the first pulley 160 and over the second pulley 161. Preferably, an idler pulley 163 is provided such that the flexible member 162 engages the second pulley 161 over 180°. If the sub-frame 17 attempts to tip such that one side is higher than the other, the effective length of the path to be followed by the flexible member 162 will be greater than when both sides are at the same height. Thus by having a taut flexible member, such tipping is prevented.

Figure 8:
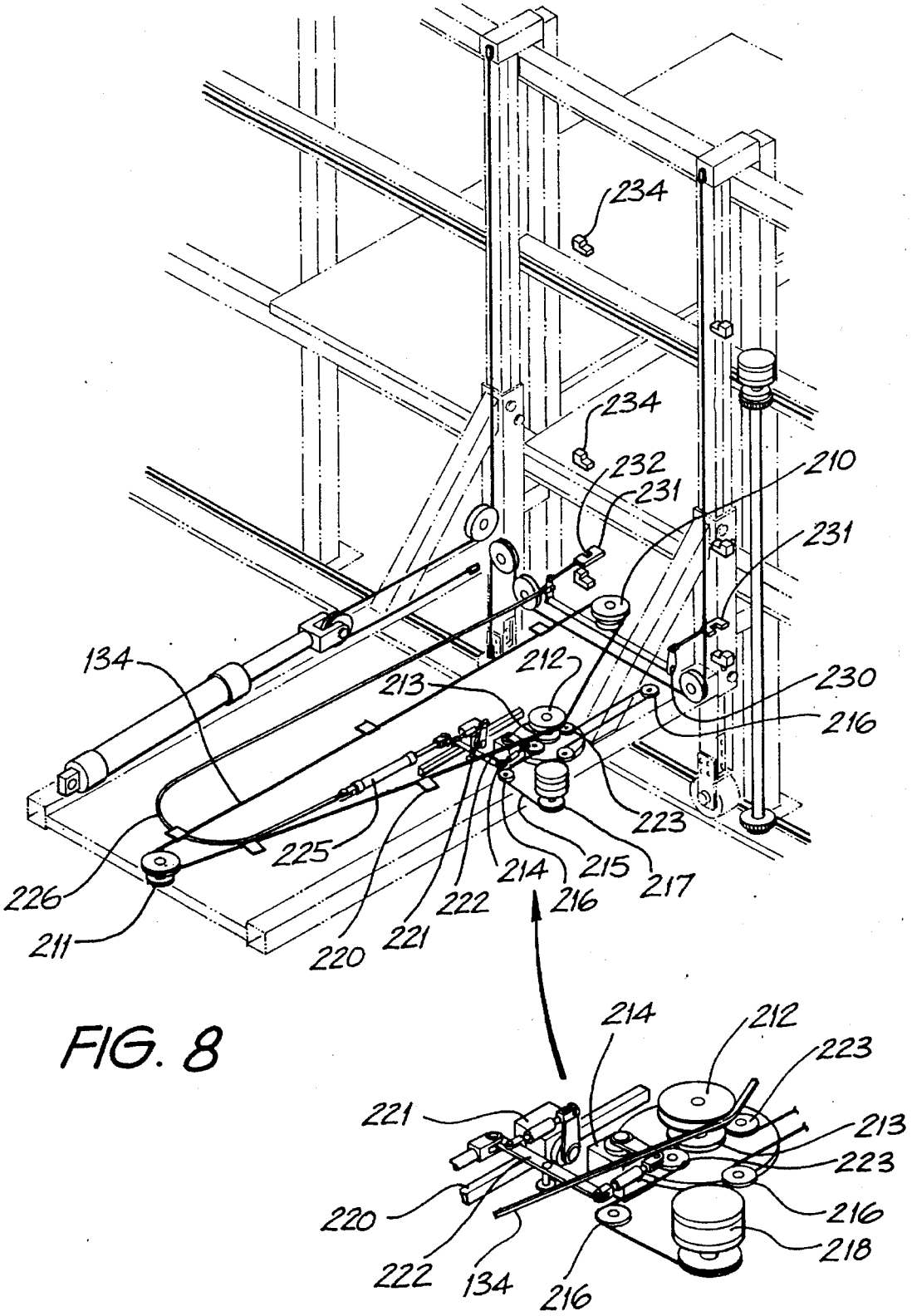
FIG. 8 shows details of an alternative drive mechanism.

Referring to FIG. 8 there is shown an alternative drive mechanism for the transfer plate 90 and pallet 20.

The transfer plate 90 has two pulleys 210 and 211 mounted at either end on its upper surface. The flexible member 134 passes around the two pulleys 210, 211 and around a third pulley 212. This pulley 212 is mounted on the transfer plate 90 and operatively connected to pulley 212 is a further pulley 213 and a brake mechanism 214. A second flexible member 215 is wrapped around the pulley 213, idler pulleys 216 and a drive pulley 217, driven by a motor 218. The idler pulleys 216, drive pulley 217 and motor 218 are mounted on the sub-frame 17. The two idler pulleys 223 are mounted on the transfer plate 90.

The sub-frame 17 is provided with a rack 220 which engages with a pinion and brake mechanism 221 on the transfer plate 90. The two brake mechanisms 214, 221 are connected to opposite ends of a bar 222, pivoted about a vertical axis at its centre 223 on the transfer plate 90. One end of the bar is connected to the piston end of a hydraulic or pneumatic ram 225. The other end of the ram is connected to a push-pull cable 226. The push-pull cable 226 is in turn connected via a pivoting lever arm mechanism 230 to two first safety lock members 231. The hydraulic ram 225 is mounted on the transfer plate 90 but is free to move along its length. The two first safety lock members 231 and the lever arm mechanism 230 are mounted on the sub-frame 17.

The two safety lock members 231 each have a cut out 232 adapted to receive a second safety lock member 234 mounted on the top surface of each parking bay floor.

The two brake mechanisms 214, 221 are spring biased against the pivoting bar 222. When the safety lock members 231 are disengaged, retraction or extension of the hydraulic ram 225 will merely cause movement of the first safety lock members 231. However when the first and second safety locks 231, 234 are engaged together, backwards or forwards motion of the locking members 231, 234 is prevented. Thus extension or retraction of the ram 225 will cause a pivoting of the bar 222. The two brake mechanisms 214, 221 are arranged such that both are never released together. When one is disengaged the other is engaged, and vice versa. Preferably when changing states both are engaged.

In use the sub-frame 17 is raised just above the desired bay and the ram 225 is actuated to extend the first lock members 231. The sub-frame 17 is lowered so the lock members 231 engage the respective lock members 234. The ram 225 is then extended to pivot bar 222 clockwise, as viewed from above and release brake mechanism 221. The motor 218 is then driven to rotate the flexible member 215 clockwise. Because the first brake mechanism 214 is still engaged the pulley 213 cannot rotate. Thus the transfer plate 90 is driven towards the right. Because the pulley 212 and hence flexible member 134 is prevented from rotating, the pallet 20 does not move relative to the transfer plate 90. Once the transfer plate 90 has been driven to its desired position, the motor 218 is stopped and the ram 225 is retracted, thereby disengaging the first brake mechanism 214 and engaging the second mechanism 221. The transfer plate 90 is thus prevented from moving relative to the sub-frame 17. The motor 218 is then driven to rotate the flexible member 215 clockwise which in turn rotates the pulley 212 and the flexible member 134 clockwise, thereby driving the pallet 20 off the transfer plate 90 towards the right and onto the parking bay floor.

Figure 6:
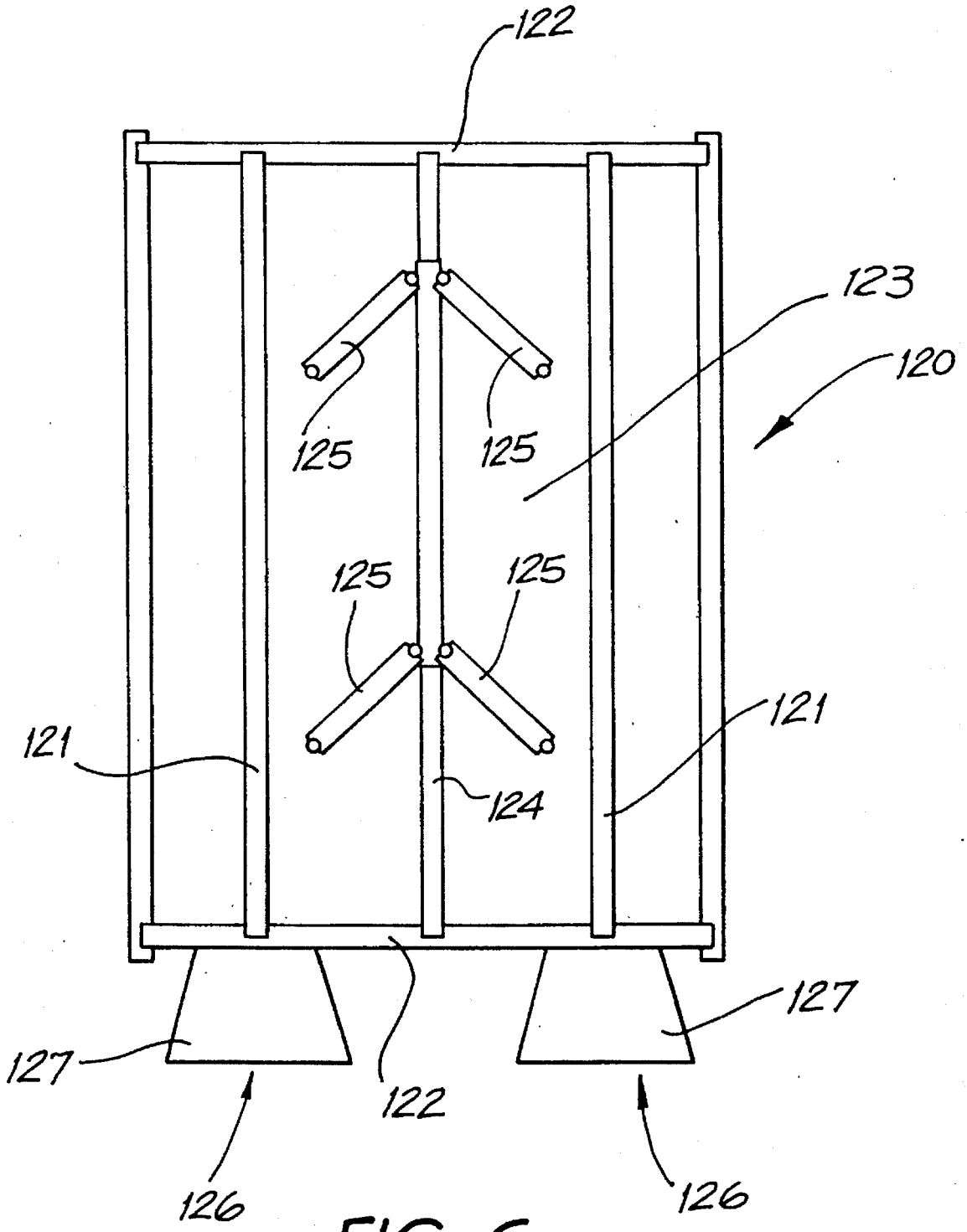
FIG. 6 is a schematic view of a pallet according to the invention.

Referring to FIG. 6 there is shown a novel pallet 120 for use in a vehicle storage system. The pallet 120 has two vehicle supporting runways 121 extending longitudinally. Each runway 121 is supported at its ends by rollers or wheels (not shown) upon trackways 122 such that transverse movement is possible. The two runways 121 are connected together by a parallelogram linkage 123 which engages a centrally located rod 124. The linkage members 125 may slide along the rod 124 such that sideways movement of one runway 121 causes a corresponding movement relative to rod of the other runway 121 in the opposite direction. The entry/exit end 126 of each runway 121 is provided with diverging guides 127 such that when a vehicle is driven towards the pallet, if not correctly aligned, its wheels will contact the sides of the guides causing the runways to move into alignment with the correct wheel spacing. Thus instead of requiring a solid floor to accommodate all sizes of vehicles, with their varying wheel spacing, only the two relatively narrow wheel runways are required, thus saving substantially on weight.

As mentioned earlier, conventional storage systems having a stationary lift have a fixed single entry/exit point. Thus persons entering a parking station must await in their vehicles until the entry/exit point is free. However the lifting mechanism of the present invention may access any "storage bay". Thus it is possible to provide the parking station with a number of bays which act as a buffer from which the lifting mechanism may take vehicles to be stored. A buffer of, for instance, three bays, in which vehicles could be temporarily left, would allow persons to leave their vehicle when the lifting mechanism is occupied without the need to wait. Similarly when a vehicle is retrieved, the lifting mechanism may retrieve another vehicle and place it in a vacant entry/exit bay even if a first entry/exit bay is still occupied. Furthermore the entry and exit points may be at different locations. Thus for example the entry point, and any buffer, may be on the lowest level while the exit point, and any buffer, may be at the highest level.

It will be apparent to those skilled in the art that many obvious modifications and variations may be made to the embodiments described herein without departing from the spirit or scope of the invention.

We claim:

1. A storage system, comprising:

a plurality of first storage bays having at least two levels, each first storage bay having an access opening through which an object may be inserted or removed, and the access openings of the first storage bays are arranged in a first common surface;

a plurality of second storage bays having at least two levels, each second storage bay having an access opening through which an object may be inserted into or removed from the storage bay, and the access openings of the second storage bays are arranged in a second common surface parallel to the first;

the first and second common surfaces are spaced apart from each other;

a first lifting transfer device movable vertically and horizontally and located adjacent the first common surface and extending to a location proximate to the second common surface including means for inserting an object into or removing an object from any of the first and second storage bays;

a second lifting transfer device, identical to the first lifting transfer device, movable vertically and horizontally and located adjacent to the second common surface and extending to a location proximate to the first common surface including means for inserting an object into or removing an object from any of the first and second storage bays;

the arrangement being such that the first and second lifting transfer devices are able to travel horizontally along their respective common surfaces and are able to pass either above or below each other without colliding.

2. A storage system, according to claim 1, wherein each lifting transfer device comprises:

transport means restrained to move in a horizontal plane and in a direction parallel to the common surface;

lift means mounted on the transport means and restrained to move vertically relative to the transport means and in a direction parallel to the common surface; and transfer means mounted on the lift means and movable perpendicular to the common surfaces to insert or remove an object.

3. A storage system, according to claim 2, wherein the transfer means of each lifting transfer device comprises:

a first wheeled trolley for receiving and supporting an object thereon, said first wheeled trolley supported on the lift means and movable thereon from a position distant from the storage bay to a position next to or partially in the storage bay, and drive means having first and second modes of operation, said first mode of operation causing said first wheeled trolley to move relative to the lift means and said second mode of operation for driving the object from the wheeled trolley into the storage bay or from the storage bay onto the wheeled trolley whilst the first wheeled trolley is prevented from moving relative to the lift means.

4. A storage system, according to claim 3, wherein in the first mode of operation the drive means simultaneously drives the object relative to the first wheeled trolley.

5. A storage system, according to claim 4, wherein the first wheeled trolley is provided with two spaced apart second running tracks extending substantially parallel with respect to one another and with respect to lateral edges of the first wheeled trolley, and wherein a second wheeled trolley is provided with a plurality of support wheels mounted such as to run in the second running tracks, constrain the second wheeled trolley to run parallel with the second running tracks and substantially prevent lateral movement thereof on the first wheeled trolley.

6. A storage system, according to claim 4, wherein the first wheeled trolley is provided with guide means which cooperate with a guide member of the second wheeled trolley to locate the latter correctly relative to the first wheeled trolley.

7. A storage system, according to claim 6, wherein said cooperation of the guide means and the guide member automatically locate the second wheeled trolley at a correct position relative to the first wheeled trolley.

8. A storage system, according to claim 3, wherein the object comprises a second wheeled trolley retrievably supportable on the first wheeled trolley and adapted to carry a wheeled vehicle.

9. A storage system, according to claim 3, wherein the first wheeled trolley comprises two vehicle supporting runways extending parallel with respect to one another and supported such as to allow variable spacing in-between them, the runways being connected together by a linkage arm mechanism adapted to allow equidistant movement of the runways relative to a central axis extending between them, and the runways being provided with guides adapted to cooperate with the wheels of a vehicle such as to cause the runways to move into alignment with the wheel spacing of the vehicles.

10. A storage system, according to claim 9, wherein said cooperation of the guides with the wheels cause the runways to automatically align with the wheel spacing of the vehicle.

11. A storage system, according to claim 2, wherein the lift means comprises two horizontally extending parallel arms respectively guided on a corresponding one of two vertically extending columns of a main frame of the transport means, the arms each having first running track extending parallel with the arms, and wherein a plurality of support wheels is mounted on the lateral edges of the first wheeled trolley to engage with the first running tracks, the wheels being mounted on the first wheeled trolley with their axis of rotation such that the first wheeled trolley is contained to run parallel with the first running tracks and is substantially prevented from lateral movement thereon.

12. A storage system, according to claim 11, wherein the plurality of wheels on the first trolley, the second trolley or both trolleys are replaced by linear bearings.

13. A storage system, according to claim 2, wherein the transport means of the first lifting transfer device is mounted on a first track adjacent to the first common surface and the lift means extends transversely away from the first common surface.

14. A storage system, according to claim 2, wherein the lift means of the first and second lifting transfer devices end short of the second and first common surfaces, respectively, such that when the first and second lifting transfer devices are opposite each other, the lift means of the first lifting transfer device do not interfere with the transport means of the second lifting transfer device.

15. A storage system, according to claim 2, wherein the transport means of the first lifting transfer device is mounted on a first track adjacent to the first common surface and the transport means of the second lifting transfer device is mounted on a second track adjacent to the second common surface and the first and the second tracks are disposed at a common level orthogonal to the first and the second common surfaces.

16. A storage system, according to claim 1, wherein said first lifting transfer device is supported only from structural members associated with the plurality of first storage bays and the second lifting transfer device is supported only from structural members associated with the plurality of second storage bays.

* * * * *